US006158705A

United States Patent [19]

Cudmore et al.

[11] Patent Number: 6,158,705

[45] Date of Patent: Dec. 12, 2000

[54] VEHICLE STABILIZATION AND SUPPORT TOOL

[75] Inventors: Stephen R. Cudmore, Surrey; Andrew A. Maynard, Aldergrove, both of Canada

[73] Assignee: Airshore International Direct Equipment West Ltd., Langley, Canada

[21] Appl. No.: 09/289,422

[22] Filed: Apr. 9, 1999

[51] Int. Cl.[7] ..... E04G 25/00

[52] U.S. Cl. ..... 248/354.1

[58] Field of Search ..... 248/354.1, 354.5, 248/357, 351, 352; 254/93 R

[56] References Cited

U.S. PATENT DOCUMENTS

| | | | |
|---|---|---|---|
| 3,851,856 | 12/1974 | Berg | 154/93 R |
| 5,515,655 | 5/1996 | Hoffmann | 248/354.5 X |
| 5,653,415 | 8/1997 | Schworer | 248/354.1 |
| 6,019,337 | 2/2000 | Brown | 248/354.5 |

*Primary Examiner*—Ramon O. Ramirez

*Attorney, Agent, or Firm*—Kolisch Hartwell Dickinson McCormack & Heuser

[57] ABSTRACT

A tool for stabilizing and supporting a vehicle by forming a rigid member between a bearing surface and the vehicle comprising at least one member having a cylinder and a movable piston that protrudes axially from the cylinder at a cylinder end. The cylinder end is formed with a pair of inclined circumferential surfaces. A collar extends axially from the cylinder and slidably receives the protruding piston. The collar is formed with a pair of internal annular step surfaces corresponding to the cylinder end surfaces. The collar step surfaces and the cylinder circumferential surfaces are engagable to permit rotation and simultaneous axial movement of the collar with respect to the cylinder. A pin is selectively positionable at one of a plurality of holes along the piston for engagement with the collar to prevent movement of the piston with respect to the collar. A locking system is provided for releasably securing the collar against rotation relative to the cylinder. In use, the piston is extended from the cylinder and the pin is inserted through one of the holes along the piston to define an initial extended position. The collar is then rotated to move axially into engagement with the pin and locked in place with respect to the cylinder to define a final fixed extended position of the tool.

7 Claims, 3 Drawing Sheets

VEHICLE STABILIZATION AND SUPPORT TOOL

FIELD OF THE INVENTION

This invention relates to a bracing and supporting tool, particularly suited for stabilizing damaged or overturned vehicles at accident scenes to permit extraction of the occupants.

BACKGROUND OF THE INVENTION

When a vehicular accident involves a badly damaged or overturned vehicle that has been crushed, the occupants can become trapped inside and it is desirable for rescue workers to be able to extract the occupants safely and quickly. In some case, it is necessary to extract the occupants by using cutting or prising equipment to remove wreckage. In order to protect the safety of the trapped vehicle occupants and the rescuers, it is often necessary to stabilize and support the vehicle so that the rescue activities do not cause further movement of the vehicle. This is particularly important in the case of overturned vehicles where the vehicle is not in a stable resting position.

Conventional methods of vehicle stabilization involve cribbing the vehicle or using a combination of blocks and wedges to hold the vehicle in place. Unfortunately, placing blocks and wedges about a vehicle can be time consuming and the blocks often restrict or prevent access to the interior of the vehicle.

In some cases, it is desirable to right or at least partially raise an overturned vehicle before attempting a rescue. This is often accomplished by deploying and inflating air bags under the vehicle. The blocks and wedges must be constantly adjusted to guide and control movement of the vehicle.

SUMMARY OF THE INVENTION

To address the shortcomings of existing stabilizing equipment and methods, applicant has developed a vehicle stabilization tool comprising a lightweight but strong elongatable strut that can be quickly and efficiently installed in place between the vehicle and a bearing surface, and then locked at a desirable length to support and stabilize the vehicle.

Accordingly, the present invention provides a tool for stabilizing and supporting a vehicle by forming a rigid member between a bearing surface and the vehicle comprising:

at least one elongatable member having a cylinder and a movable piston that protrudes axially from the cylinder at a cylinder end formed with a pair of inclined circumferential surfaces;

a collar that extends axially from the cylinder and slidably receives the protruding piston, the collar being formed with a pair of internal annular step surfaces corresponding to the cylinder end surfaces, the collar step surfaces and the cylinder circumferential surfaces being engagable to permit rotation and simultaneous axial movement of the collar with respect to the cylinder;

a stop selectively positionable at one of a plurality of positions along the piston for engagement with the collar to prevent movement of the piston with respect to the collar; and a locking system for releasably securing the collar against rotation relative to the cylinder;

whereby the piston is extended from the cylinder and the stop is positioned at one of the plurality of positions along the piston to define an initial extended position of the tool, and the collar is then rotated to move axially into engagement with the stop and locked in place with respect to the cylinder to define a final fixed extended position of the tool.

In a preferred arrangement, the tool of the present invention incorporates a pivotable base that self adjusts as the angle of the tool changes to accommodate movement of the vehicle.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
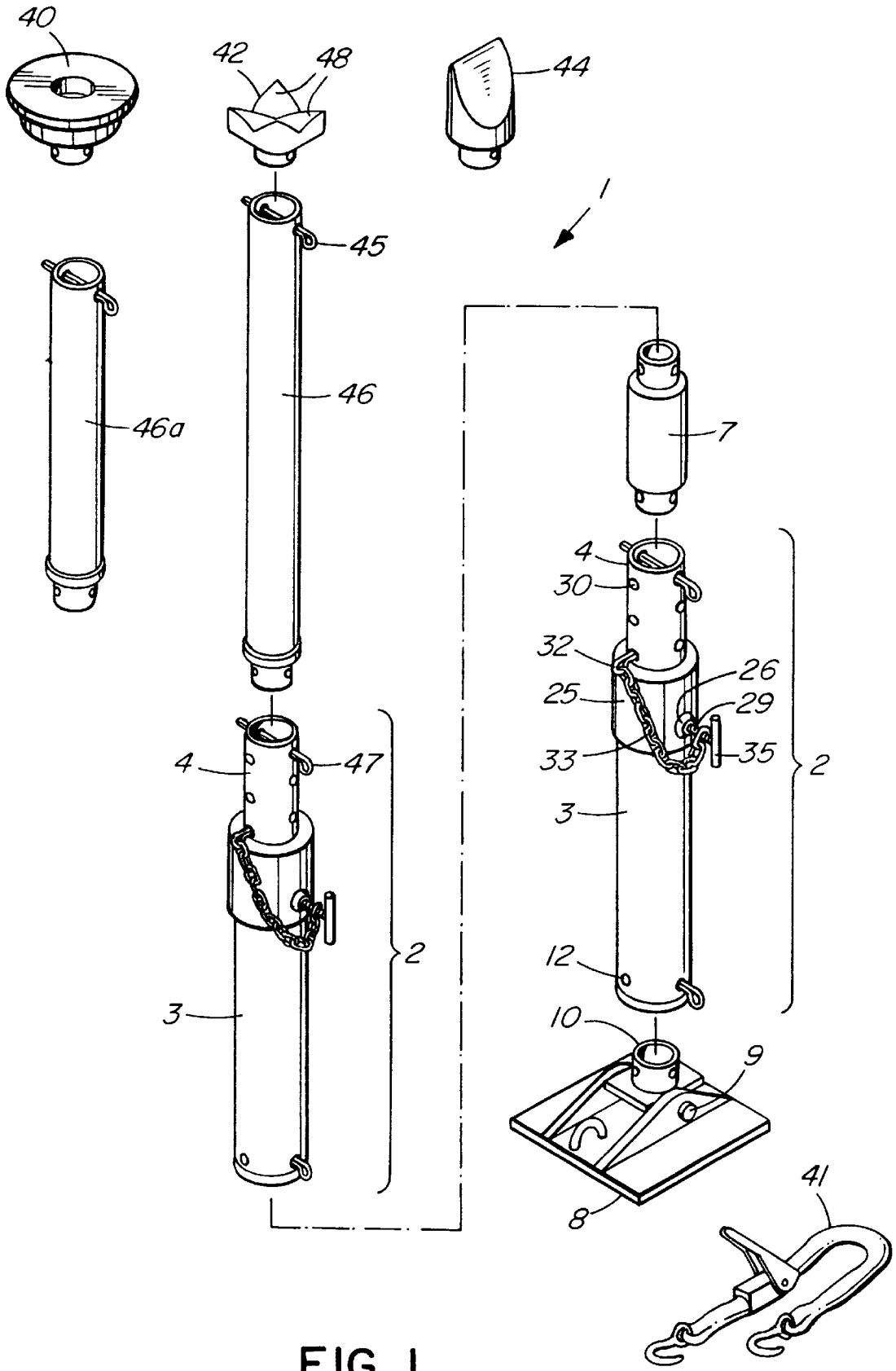
FIG. 1 is a exploded view of the tool according to a preferred embodiment of the present invention.
Figure 2:
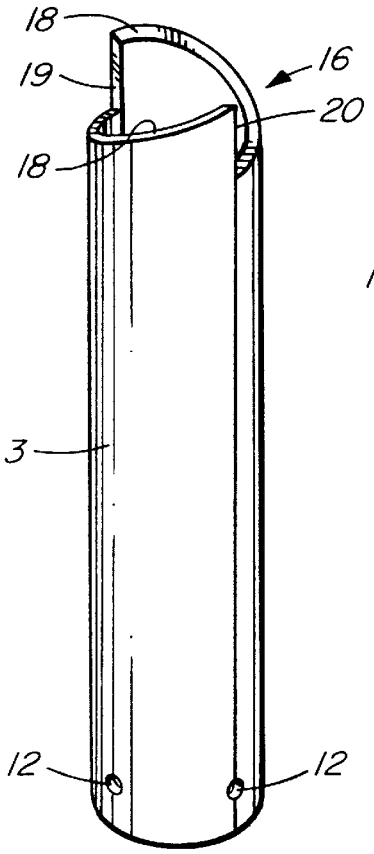
FIG. 2 is a perspective view of the cylinder of the tool.

Referring to FIG. 1, there is shown an exploded view of the tool 1 of the present invention formed from a pair of elongatable members 2. Each elongatable member 2 is identical and comprises a hollows cylinder 3 and a movable piston 4 that protrudes axially from the cylinder. Piston 4 can be extended from cylinder 3 to a desired length to form a bracing structure between the vehicle and a bearing surface. Piston 4 is preferably tubular. Depending on the circumstances, a single elongatable member 2 may be necessary to perform a bracing job or multiple members 2 may be attached together end to end using a connecting member 7 which will be described in more detail below.

Base 8 is provided to support the lower end of the elongatable member 2. Base 8 is a plate having a pivotal joint 9 adapted for releasable attachment to the lower end of elongatable member 2. In a preferred arrangement, joint 9 includes an upstanding cylindrical post 10 dimensioned to fit within the open lower end of cylinder 3. Post 10 is formed with a passage therethrough, and the walls of cylinder 3 are formed with diametrically opposed holes 12. A pin is insertable through holes 12 and the passage to lock cylinder 3 to base 8. Base 8 is designed to be freely pivotable with respect to cylinder 3 to allow automatic adjustment of the base as the angle of the tool changes with any movement of the vehicle.

Figure 4:
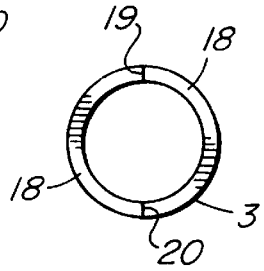
FIG. 4 is a top view of the cylinder of FIG. 2.
Figure 3:
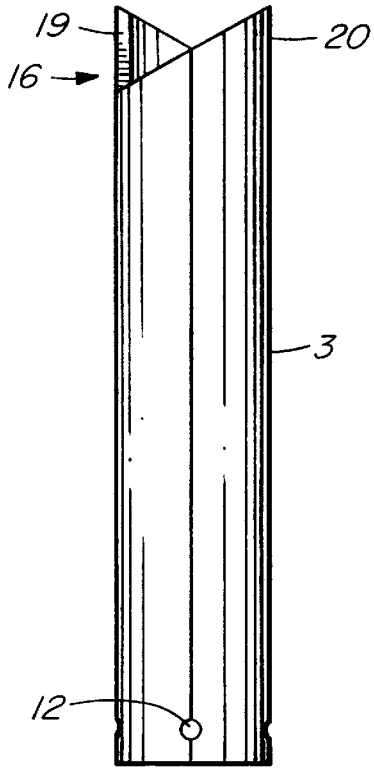
FIG. 3 is a side elevation view of the cylinder of FIG. 2.
Figure 5:
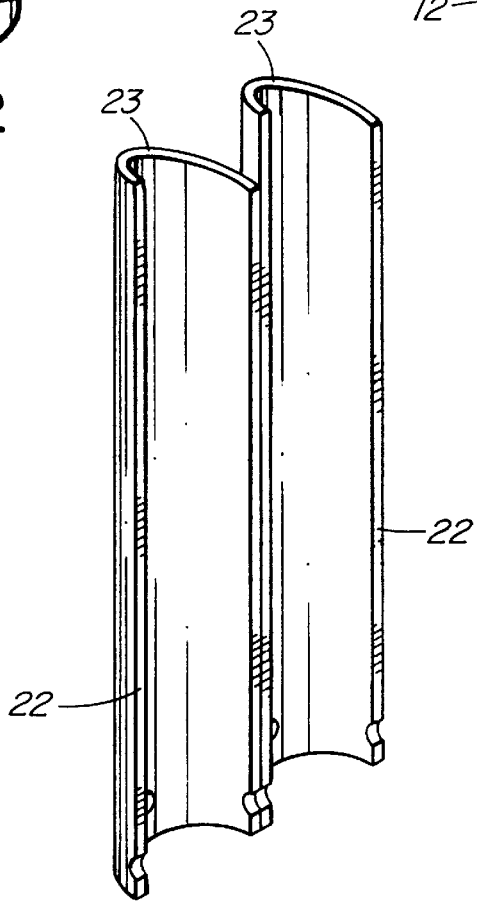
FIG. 5 shows a pair of half cylinders that can be assembled to form the cylinder of FIG. 2.
Figure 6:
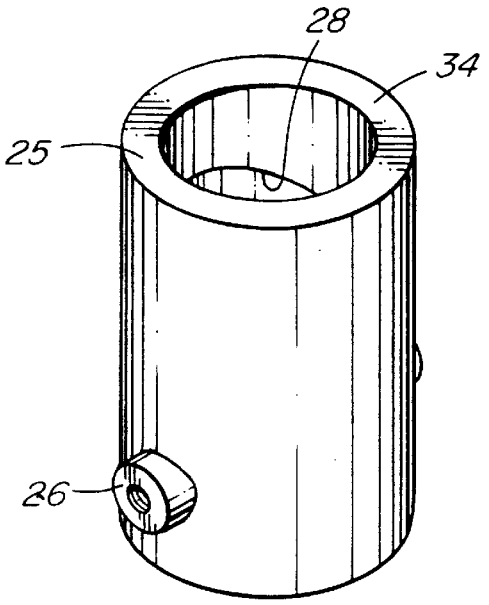
FIG. 6 is a perspective view of the collar of the tool of the present invention.
Figure 7:
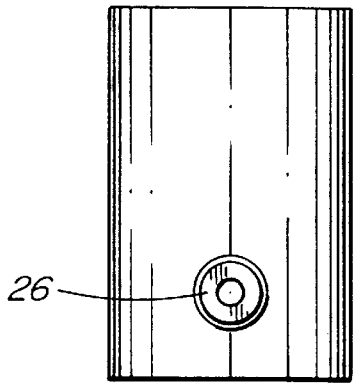
FIG. 7 is a side elevation view of the collar of FIG. 6.
Figure 8:
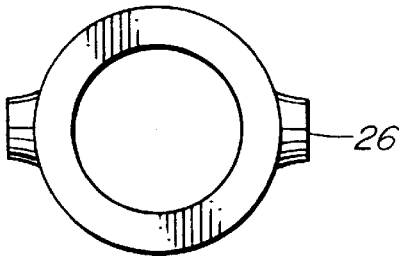
FIG. 8 is a top view of the collar of FIG. 2.

FIGS. 2 to 5 are detailed views of the cylinder 3 of elongatable member 2. The upper end 16 of cylinder 3 is formed with a pair of symmetric inclined circumferential surfaces 18. Each surface 18 extends through substantially 180° and terminates at stop faces 19 and 20 at their upper and lower ends. FIG. 5 shows a preferred manner in which cylinder 3 can be formed by joining together two identical half cylinders 22, each having one end 23 cut at an angle.

Figure 9:
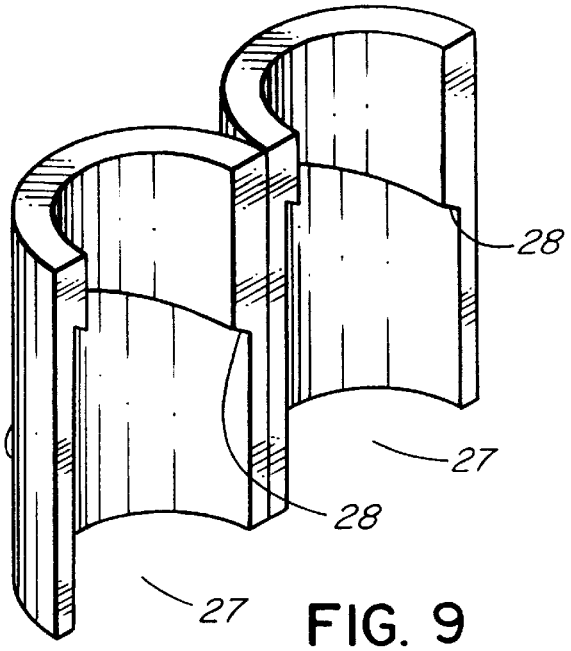
FIG. 9 shows a pair of half cylinders that can be assembled to form the collar of FIG. 6.

There is a cylindrical collar 25 that fits over top of the upper end 16 of cylinder 3 which is shown in more detail in FIGS. 6 to 9. When in position atop cylinder 3, collar 25 extends axially from the cylinder and slidably receives protruding piston 4 through the centre of the collar. As best shown in FIG. 9, collar 25 is formed with a region 27 of enlarged diameter that fits over cylinder 3. Region 27 ends at a pair of internal annular step surfaces 28 that correspond to the cylinder end surfaces 22. As is the case with cylinder 3, collar 25 is best formed from a pair of joined half cylinders as shown in FIG. 9.

Collar step surfaces 28 and the cylinder circumferential surfaces 22 are engagable to permit rotation and simultaneous axial movement of the collar 25 with respect to cylinder 3.

Collar 25 also includes a locking system for releasably securing the collar against rotation relative to the cylinder. The locking system comprises a threaded boss 26 in the wall of the collar and a threaded stud 29 engaged in the boss. Stud 29 has a handle 35 to permit the stud to be tightened into engagement with cylinder 3 to prevent relative rotation of collar 25 with respect to cylinder 3.

A stop in the form of pin 32 is provided to be selectively positioned at one of a plurality of positions along piston 4. As best shown in FIG. 4, piston 4 is formed with a plurality of passages 30 therethrough that define a series of spaced locations along the piston into which pin 32 can be inserted. Once inserted, the protruding portions of pin 32 engage with the upper edge 34 of collar 25 to prevent movement of the piston with respect to the collar. As best shown in FIG. 1, pin 32 is preferably connected to stud 29 by a chain 33 to prevent accidental loss of the pin.

In order to reliably position the tool of the present invention against a vehicle to be stabilized, various vehicle engaging members 40, 42, and 44 are provided as shown in FIG. 1. Preferably, these vehicle engaging members are releasably connected via pin 45 to an extension member 46 that is connected via pin 47 to the end of piston 4. Vehicle engaging member 40 is intended for use when a flat support surface is available on the vehicle. Vehicle engaging member 42 is intended for use along an exposed edge or seam of the vehicle structure with the edge or seam being received and retained in the channels formed between the four lobes 48 of the member. Vehicle engaging member 44 is designed to be wedged into a corner or joint of the vehicle.

It is also desirable, in many cases, to provide a strap 41 which incudes hook members at each end for installation between base 8 and the vehicle being stabilized to prevent movement of the base.

Extension member 46 can be used to adjust the length of the tool depending on the stabilization job required. For example, extension member 46 can be provided in various lengths. FIG. 1 shows a shorter extension member 46*a*.

It is also possible to incorporate two elongatable members 2 into the tool by a connecting member 7 to adjust the length of the tool. Connecting member 7 is preferably a short length of tube that is mountable via pins between the upper end of piston 4 of a lower elongatable member and the lower end of an upper elongatable member.

Preferably, the component parts of the tool of the present invention are manufactured from a lightweight but strong material such as aluminium.

In use, the tool of the present invention is assembled to approximately the desired length by selecting and interconnecting base 8, one or more elongatable members 2, an extension member 46 and a vehicle engaging member. The vehicle engaging member is selected to permit the most reliable and secure contact with the vehicle to be stabilized. Base 8 is firmly planted at a bearing location and piston 4 is then extended from cylinder 3 until the vehicle engaging member makes contact with the vehicle. Pin 32 is then inserted into the set of exposed passages 30 nearest to the upper edge 34 of collar 25. Collar 25 is then rotated using handle 35 on stud 29 to move collar 25 axially with respect to cylinder 3 into tight contact with pin 32 to fix the length of the tool. Handle 35 is then used again to tighten stud 29 into boss 26 of collar 25 to lock the collar in place to define a final fixed extended position of the tool. Strap 41 is attached between base 8 and the vehicle to prevent slipping of the base. This process is repeated to install as many stabilization tools as necessary to reliably and safely secure and stabilize the vehicle so that rescue workers can then attend to the safe extrication of the trapped occupants.

Although the present invention has been described in some detail by way of example for purposes of clarity and understanding, it will be apparent that certain changes and modifications may be practised within the scope of the appended claims.

What is claimed is:

1. A tool for stabilizing and supporting a vehicle by forming a rigid member between a bearing surface and the vehicle comprising:

at least one elongatable member having a cylinder and a movable piston that protrudes axially from the cylinder at a cylinder end formed with a pair of inclined circumferential surfaces;

a collar that extends axially from the cylinder and slidably receives the protruding piston, the collar being formed with a pair of internal annular step surfaces corresponding to the cylinder end surfaces, the collar step surfaces and the cylinder circumferential surfaces being engagable to permit rotation and simultaneous axial movement of the collar with respect to the cylinder;

a stop selectively positionable at one of a plurality of positions along the piston for engagement with the collar to prevent movement of the piston with respect to the collar; and a locking system for releasably securing the collar against rotation relative to the cylinder;

whereby the piston is extended from the cylinder and the stop is positioned at one of the plurality of positions along the piston to define an initial extended position of the tool, and the collar is then rotated to move axially into engagement with the stop and locked in place with respect to the cylinder to define a final fixed extended position of the tool.

2. A tool as claimed in claim 1 wherein the inclined circumferential surfaces of the cylinder and the internal step surfaces of the collar are formed with stop faces at each end of the surfaces.

3. A tool as claimed in claim 1 wherein the plurality of positions along the piston comprise a series of passages extending through the piston and the stop is a pin insertable through any one of the passages.

4. A tool as claimed in claim 1 in which the at least one elongatable member is pivotally connectable to a base at one end.

5. A tool as claimed in claim 4 in which the at least one elongatable member is releasably connectable to a vehicle engaging member at the end opposite the base.

6. A tool as claimed in claim 5 including an extension member connectable between the piston member and the vehicle engaging member.

7. A tool as claimed in claim 4 including a connecting member for joining the at least one elongatable member end to end to another elongatable member.

* * * * *